US006512901B2

(12) United States Patent
Uno

(10) Patent No.: US 6,512,901 B2
(45) **Date of Patent: *Jan. 28, 2003**

(54) METHOD AND APPARATUS FOR IMAGE FORMING CAPABLE OF PREVENTING A CONTAMINATION OF A BRUSH-ROLLER CHARGER

(75) Inventor: Mugijiroh Uno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/754,505

(22) Filed: Jan. 4, 2001

(65) Prior Publication Data

US 2001/0026695 A1 Oct. 4, 2001

(30) Foreign Application Priority Data

Feb. 18, 2000 (JP) ..... 2000-040698

(51) Int. Cl.[7] ..... G03G 15/02; G03G 21/00
(52) U.S. Cl. ..... 399/100; 399/175
(58) Field of Search ..... 399/50, 100, 101, 399/175, 287, 353, 354; 430/67

(56) References Cited

U.S. PATENT DOCUMENTS 5,508,788 A * 4/1996 Watanabe et al. ..... 399/175
5,538,826 A * 7/1996 Ainoya et al. ..... 430/67 X
5,576,807 A * 11/1996 Osawa et al. ..... 399/175
5,652,649 A * 7/1997 Ikegawa et al. ..... 399/175
6,022,660 A * 2/2000 Uno ..... 430/110
6,067,426 A * 5/2000 Kawakami ..... 399/50

FOREIGN PATENT DOCUMENTS

| | | | |
|---|---|---|---|
| JP | 4-313785 | * | 11/1992 |
| JP | 6-289755 | | 10/1994 |
| JP | 7-89627 | | 4/1995 |
| JP | 11-45000 | * | 2/1999 |

OTHER PUBLICATIONS

U.S. Patent Application Serial No. 09/429,305, filed Oct. 28, 1999, and an Amendment therein in response to an Office Action dated Jun. 15, 2000.

* cited by examiner

*Primary Examiner*—Joan Pendegrass
(74) *Attorney, Agent, or Firm*—Cooper & Dunham LLP

(57) ABSTRACT

A method for cleaning a charging brush which charges a drum including an electroconductive substrate and an insulating surface layer over the electroconductive substrate, including the steps of grounding the electroconductive substrate of the drum contacting a brush portion of the charging brush with the insulating surface of the drum while the charging brush and the drum are rotated and applying an alternating electric field to the brush portion of the charging brush to vibrate to brush portion to remove fouling adhered to the brush portion.

25 Claims, 3 Drawing Sheets

METHOD AND APPARATUS FOR IMAGE FORMING CAPABLE OF PREVENTING A CONTAMINATION OF A BRUSH-ROLLER CHARGER

BACKGROUND

1. Field

This patent specification relates to a method and a device for cleaning a charging brush which charges a surface of a photoconductive element to be used in an electrophotographic process of an image forming apparatus, such as a copying machine, a facsimile, and a printer, etc., and more particularly to a method and a device that can effectively clean a charging brush at a reduced cost.

2. Discussion

A roll-shaped brush structure, having a large number of elastic, electrically conductive threads at its outer periphery to charge a surface of a photoconductive element used in an electrophotographic printing process, is commonly known. The charging brush contacts the surface of the photoconductive element and applies a high voltage to the surface thereof so as to cause corona discharge, thereby electrostatically charging the surface of the photoconductive element.

The useful life of the charging brush ends when it becomes unable to cause effective corona discharge due to fouling, such as toner or an additive to toner adhered to the conductive threads of the brush. As described in Japanese Patent Laid-Open Publications Nos. 6-289755 and 7-89627, it may be comparatively easy to remove fouling from a charging roller that does not have a brush structure, by washing the charging roller. However, it is difficult to recycle a charging brush which is at the end of its useful life.

The reason why it is difficult to recycle a charging brush which is at the end of its life due to the above-described fouling by material adhering to conductive threads of the brush, is believed to be as follows.

It is believed that the fouling material needs to be removed before a used charging brush could be reused. A charging brush is generally constructed of a pile fabric of conductive threads, which is secured to a metal sheet or is wound around a shaft in a shape of a roller. An attempt can be made to remove fouling adhered to a charging brush by using an air blow or by scraping off with a scraper. However, when the fouling is removed by the above-mentioned methods, it is likely that at least some of the conductive threads will come out as well, thereby causing abnormal discharge or cutting off an exposure optical path in an electrophotographic printing process. When the fouling is swept by the scraper, tips of the conductive threads might be scraped which may damage the conductive threads and cause abnormal discharge. In addition, because the conductive thread is deformed due to an excessive force exerted thereon, an outside shape or dimensions set for the charging brush may not be maintained.

Various proposals have been made to address the above-mentioned problems. When a recycling process to reuse a charging brush is performed, it is important that costs involved are kept to a minimum by decreasing the work needed for the process. It is believed that costs cannot be satisfactory decreased with the known prior art technology in which a specific jig is used or the amount of work is not sufficiently decreased.

A method for reducing total costs involved in recycling work has been proposed. According to this method, a current leak caused when a photoconductive drum is damaged is checked at the time when a changing brush is cleaned. Specifically, a current leak check is carried out by running a current. When a photoconductive element is damaged such that a portion of a photoconductive layer thereof has come off and the ground (GND) layer is exposed, an excessive current is fed to an exposed portion of a ground (GND) layer from a charging brush. At least a portion of the charging brush can burn or otherwise be damaged due to the passage of the excessive current, and thereby the charging brush may become unsuitable for further use. Also, the photoconductive element may become unsuitable for further use because burnt out conductive threads may stick at the place where the portion of the ground (GND) layer of the photoconductive element is exposed.

As described above, the prior proposal may lead to making unusable both the photoconductive element and the charging brush by performing a cleaning of the charging brush and a current leak check of the photoconductive element at the same time.

SUMMARY

An object of the disclosure herein is to overcome the above-mentioned and other problems.

The system and method disclosed herein advantageously provide a novel charging brush cleaning device wherein a charging brush used in an electrophotographic printing process can be cleaned effectively by reducing the total costs involved without decreasing the performance of the charging brush.

According to preferred embodiments, fouling adhered to a charging brush is removed by vibrations caused in a portion of the charging brush by an alternating electric field applied thereto.

BRIEF DESCRIPTION OF THE DRAWINGS

A more complete appreciation of the system and method disclosed herein and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
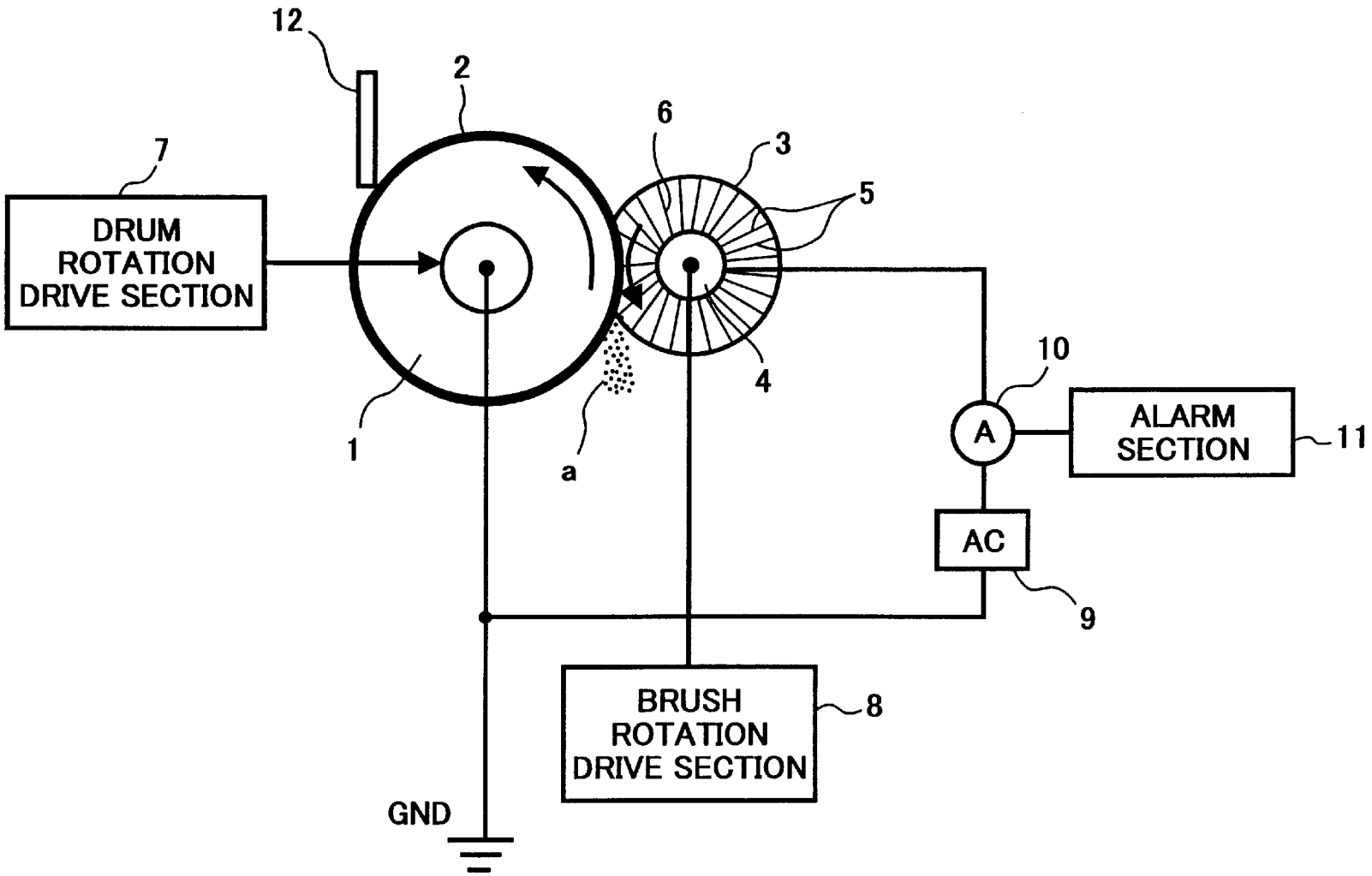
FIG. 1 is a schematic drawing illustrating an exemplary construction of a cleaning device according to a first embodiment.

Referring now to the drawings, wherein like reference numerals designate identical or corresponding parts throughout the several views, FIG. 1 is a schematic drawing illustrating an exemplary construction of a cleaning device according to a first preferred embodiment. A cylindrical drum 1 includes an inner wall which is grounded (GND), and an outer surface which is overlaid by an insulator 2. A charging brush roller 3 includes a brush 6 having a large number of elastic, electrically conductive threads 5 arranged on an outer periphery of a core shaft 4. A drum rotation drive section 7 rotatably drives the drum 1. A brush rotation drive section 8 rotatably drives the charging brush roller 3.

An alternating electric field supply section 9 applies an alternating electric field to the charging brush roller 3. One side of the alternating electric field supply section 9 is connected to the drum 1 and another to the charging brush roller 3, to thereby apply AC voltage therebetween. A current control section 10, which is disposed in the alternating. electric field supply section 9, prevents a passage of a current when it detects a flow of the current which is equal to or greater than a predetermined value. An alarm section 11 includes a lamp and/or a buzzer for giving an indication to an operator when passage of excessive current is detected by the current control section 10. A cleaning blade 12 removes fouling on a surface of the drum 1.

A cleaning method using a cleaning device having the above-mentioned configuration will now be described below.

The charging brush roller 3 is set such that a surface of the drum 1 extends into the brush 6 of the charging brush roller 3 by approximately 0.5 mm (i.e., the surface of the drum 1 digs into the brush 6 by approximately 0.5 mm). Then, the drum rotation drive section 7 rotatably drives the drum 1 at a circumferential velocity of about 40 mm/sec. At the same time, the brush rotation drive section 8 rotatably drives the charging brush roller 3 at about 1.5 times the circumferential velocity of the drum 1 in the reverse direction of the rotation of the drum 1. In addition, an alternating electric field of 1500 volts and 2000 Hz frequency is applied to the charging brush roller 3 by the alternating electric field supply section 9 while the charging brush roller 3 and the drum 1 are rotated.

By applying the alternating electric field to the charging brush roller 3, minute vibrations are generated in the brush 6 by an electromagnetic force produced in or at the conductive threads 5. Fouling "a", such as toner or an additive which has adhered to the conductive threads 5, is sifted or shed by the vibrations. Thus, the charging brush roller 3 is cleaned.

According to this cleaning method, an effective cleaning of the charging brush roller 3 is performed without imposing an excessive load on the conductive threads 5.

If the drum 1 becomes damaged, excessive current may be fed to the charging brush roller 3 from the alternating electric field supply section 9. In such a case, a current control section 10 detects the passage of excessive current. Then, a current limiter in the current control section 10 functions to end the feeding of the excessive current to the brush 6, thus keeping the conductive threads 5 from being burnt or otherwise damaged, and keeping the drum 1 from damage such as by burnt or melted threads 5. When the drum 1 is damaged, a passage of an excessive current is detected by the current control section 10. Then, a lamp or a buzzer in the alarm section 11 is activated based on a detection signal from the current control section 10 to report the possible damage caused to the drum 1 to an operator.

Figure 2:
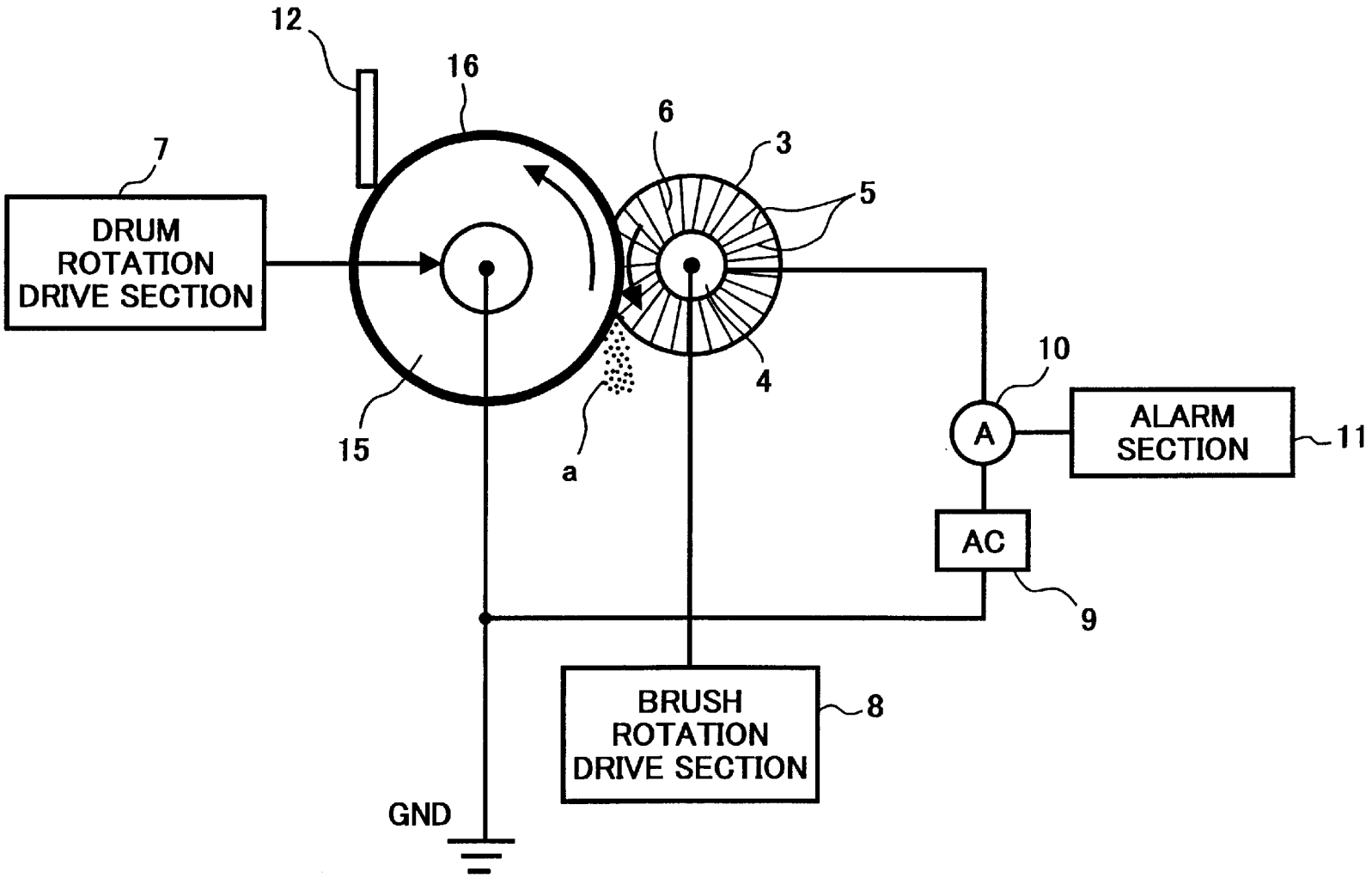
FIG. 2 is a schematic drawing illustrating an exemplary construction of a cleaning device according to a second embodiment.

FIG. 2 is a schematic drawing illustrating an exemplary construction of a cleaning device according to a second embodiment. A difference in the construction of the device between the first embodiment and the second embodiment is that a photoconductive drum 15 used in an electrophotographic printing process employed in the second embodiment instead of the drum 1 employed in the first embodiment. The construction of the drum 1 and that of the photoconductive drum 15 are identical with each other. The photoconductive drum 15 is cylindrical in shape. An inner wall of the photoconductive drum 15 is grounded (GND), and an outer surface of it is overlaid with an electrical insulator 16. The same reference numerals that designate corresponding members in the first embodiment are used in the second embodiment and a description of the identical members will be omitted.

Because a cleaning method according to the second embodiment is identical to that in the first embodiment, a description of the cleaning method also will be omitted. According to the second embodiment, whether or not the photoconductive drum 15 becomes damaged is detected at the same time the charging brush roller 3 is cleaned, which can be an advantage over the first embodiment.

When the photoconductive drum 15 is damaged, a passage of an excessive current can be detected by an operation of the current limiter of the current control section 10. Based on a detection signal from the current control section 10, a lamp and/or a buzzer is activated in the alarm section 11 to inform an operator of the damage caused to the photoconductive drum 15. Because the current limiter of the current control section 10 is not activated when the photoconductive drum 15 is not damaged, the photoconductive drum 15 is deemed to be suitable for recycling, and the absence of an activation of the alarm section 11 can be used to identify a drum 15 that need not be replaced because it still has useful life left.

Figure 3:
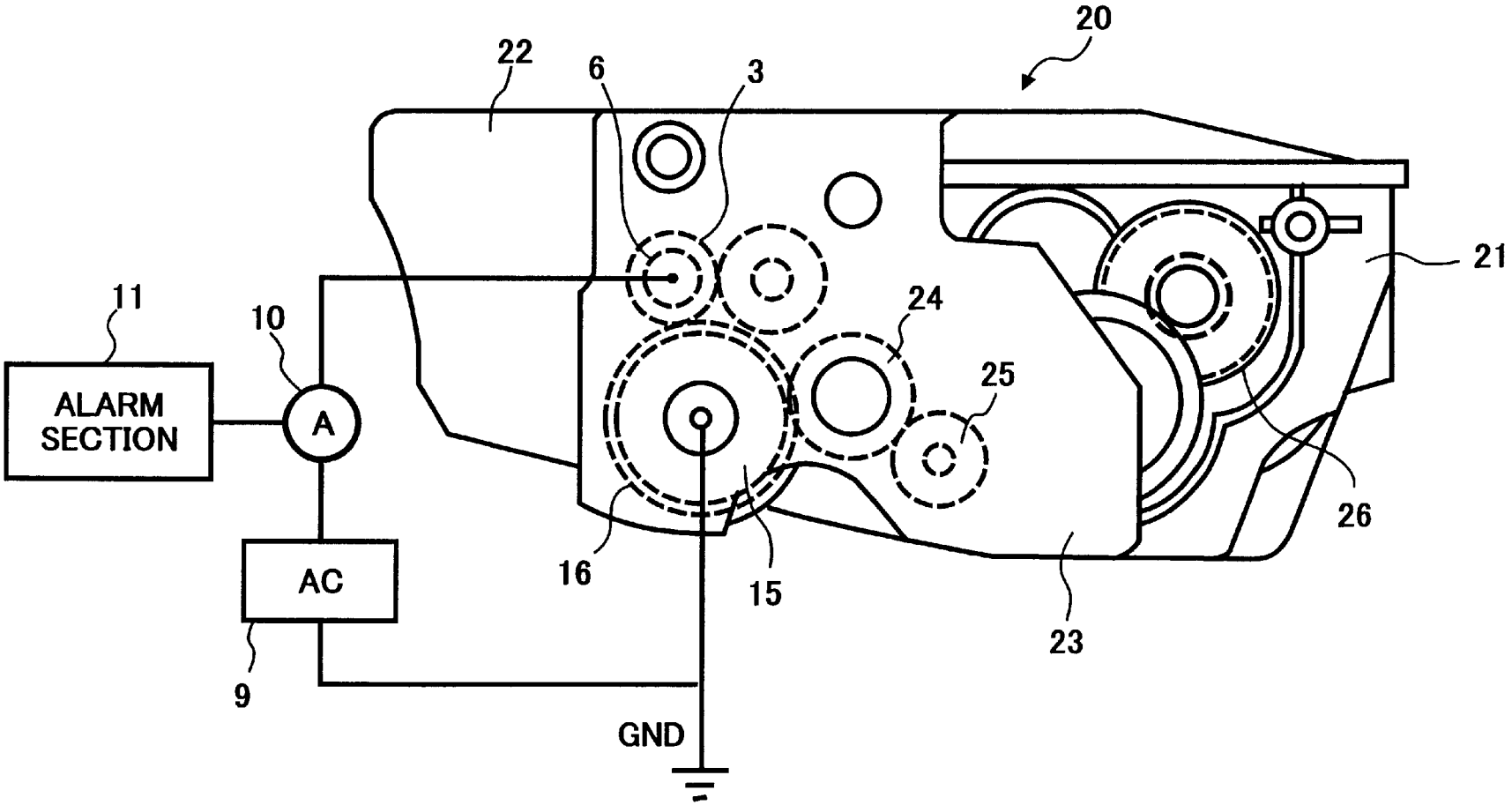
FIG. 3 is a schematic drawing illustrating an exemplary construction of a cleaning device according to a third embodiment.

FIG. 3 is a schematic drawing illustrating an exemplary construction of a cleaning device according to a third embodiment. According to the third embodiment, the charging brush roller 3 and the photoconductive drum 15 are installed in a process cartridge 20 used in an electrophotographic printing process. The charging brush roller 3 is cleaned and damage of the photoconductive drum 15 is detected while they are installed in the process cartridge 20 without dismantling the process cartridge 20. The same reference numerals designate corresponding members in FIGS. 1 and 2 are used in the third embodiment and a description of the identical members will be omitted.

The process cartridge 20 in FIG. 3 has been used and reclaimed to be recycled. The process cartridge 20 includes a new toner containing section 21 filled with fresh toner, a used toner containing section 22 where used toner is contained, and an image forming section 23. The image forming section 23 includes members used in an electrophotographic printing process, such as the photoconductive drum 15, which is cylindrical-shaped and an inner wall of it is grounded while a surface of it is overlaid with the insulator 16, and the brush 6 having a large number of conductive threads 5 arranged on an outer periphery of the core shaft 4.

The image forming section 23 also includes the charging brush roller 3, a developing roller 24 to develop a latent image formed on the photoconductive drum 15, a toner supply roller 25 to supply the developing roller 24 with toner, a rotation drive section 26 including a plurality of gears which rotatably drive the photoconductive drum 15 and the charging brush roller 3.

A cleaning device includes the alternating electric field supply section 9 which applies an alternating electric field to the charging brush roller 3 and has a grounded pole connected to the photoconductive drum 15. The cleaning device also includes the charging brush roller 3, the current control section 10, which is disposed in the alternating electric field supply section 9 and which prevents a passage of a current when it detects a current which is equal to or greater than a predetermined value, and the alarm section 11 including a lamp and/or a buzzer for giving an indication to an operator when passage of excessive current is detected by the current control section 10.

According to the third embodiment, the charging brush roller 3 is cleaned in the same manner as described in the first embodiment, and whether or not the photoconductive drum 15 becomes damaged is detected in the same manner as described in the second embodiment while the charging brush roller 3 and the photoconductive drum 15 are installed in the process cartridge 20 without dismantling the process cartridge 20. The above-described cleaning of the charging brush roller 3 and the detection of damage caused to the photoconductive drum 15 can be performed when the process cartridge 20 is set to a predetermined position in the cleaning device.

In addition, according to the third embodiment, the photoconductive drum 15 and the charging brush roller 3 can be rotatably driven by the rotation drive section 26 which is included in the process cartridge 20. Therefore, it may eliminate necessity of including the rotation drive section 26, which rotates the photoconductive drum 15 and the charging brush roller 3, in the cleaning device.

In the above-described embodiments, the charging brush roller 3 and the drum 1 (or the photoconductive drum 15) can be configured to rotate relatively such that they may slide in contact with each other. The method of cleaning according to the present invention can be applied not only to the charging brush roller 3 but also to other brush-shaped members that have conductive threads and are used in an electrophotographic printing process. A photoconductive belt or other structure can be used in place of the drums 1 and 15.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-040698, filed on Feb. 18, 2000, and the entire contents thereof are herein incorporated by reference.

What is claimed as new and is desired to be Secured by Letters Patent of the United States is:

1. A method for cleaning a charging brush which charges a drum including an electroconductive substrate and an insulating surface layer over the electroconductive substrate, comprising:

grounding the electroconductive substrate of said drum;

contacting a brush portion of said charging brush with the insulating surface of said drum while said charging brush and said drum are rotated; and applying an alternating electric field not including a DC component to the brush portion of said charging brush to vibrate the brush portion to remove fouling adhered to the brush portion.

2. A method for cleaning a charging brush which charges a drum including an electroconductive substrate and an insulating surface layer over the electroconductive substrate, comprising:

grounding the electroconductive substrate of said drum;

contacting a brush portion of said charging brush with the insulating surface of said drum while said charging brush and said drum are rotated;

applying an alternating electric field to the brush portion of said charging brush to vibrate the brush portion to remove fouling adhered to the brush portion;

detecting a current applied to the brush portion of said charging brush in the alternating field applying step; and regulating the current to prevent excessive current flow through the brush portion of said charging brush.

3. A method for cleaning a charging brush which charges a drum including an electroconductive substrate and an insulating surface layer over the electroconductive substrate, comprising:

grounding the electroconductive substrate of said drum;

contacting a brush portion of said charging brush with the insulating surface of said drum while said charging brush and said drum are rotated;

applying an alternating electric field to the brush portion of said charging brush to vibrate the brush portion to remove fouling adhered to the brush portion;

detecting a current applied to the brush portion of said charging brush in the alternating field applying step;

regulating the current to prevent excessive current flow through the brush portion of said charging brush; and indicating an excessive current when a passage of said current equal to or greater than a predetermined value is detected.

4. A method for cleaning a charging brush which charges a photoconductive drum including an electroconductive substrate, a photoconductive layer over the electroconductive substrate, and an insulating layer over the photoconductive layer, comprising:

grounding the electroconductive substrate of said photoconductive drum;

contacting a brush portion of said charging brush with said insulating layer of said photoconductive drum while said charging brush and said photoconductive drum are rotated; and applying an alternating electric field not including a DC component to the brush portion of said charging brush to vibrate the brush portion of said charging brush to remove fouling adhered to the brush portion of said charging brush.

5. A method for cleaning a charging brush which charges a photoconductive drum including an electroconductive substrate and photoconductive layer over the electroconductive substrate, comprising:

grounding the electroconductive substrate of said photoconductive drum;

contacting a brush portion of said charging brush with said photoconductive layer of said photoconductive drum while said charging brush and said photoconductive drum are rotated;

applying an alternating electric field to the brush portion of said charging brush to vibrate the brush portion of said charging brush to remove fouling adhered to the brush portion of said charging brush;

detecting a current applied to the brush portion of said charging brush in the alternating field applying step; and regulating the current to prevent excessive current flow through the brush portion of said charging brush.

6. A method for cleaning a charging brush which charges a photoconductive drum including an electroconductive substrate and photoconductive layer over the electroconductive substrate, comprising:

grounding the electroconductive substrate of said photoconductive drum;

contacting a brush portion of said charging brush with said photoconductive layer of said photoconductive drum while said charging brush and said photoconductive drum are rotated;

applying an alternating electric field to the brush portion of said charging brush to vibrate the brush portion of said charging brush to remove fouling adhered to the brush portion of said charging brush;

detecting a current applied to the brush portion of said charging brush in the alternating field applying step;

regulating the current to prevent excessive current flow through the brush portion of said charging brush; and indicating an excessive current when a passage of said current equal to or greater than a predetermined value is detected.

7. An image forming apparatus, comprising:

a drum including an electroconductive substrate and an insulating surface layer over the electroconductive substrate, the electroconductive substrate of said drum being grounded;

a charging brush configured to charge a surface of said drum;

a rotation drive section configured to rotatably drive said charging brush; and an alternating electric field supply section configured to apply an alternating electric field not including a DC component to a brush portion of said charging brush, wherein the brush portion of said charging brush contacts the insulating surface layer of said drum to vibrate the brush portion of said charging brush, while the alternating electric field is applied to the brush portion of said charging brush and while said charging brush and said drum are rotated, thereby removing fouling from brush portion of said charging brush.

8. The image forming apparatus according to claim 7, wherein said drum is a photoconductive drum.

9. The image forming apparatus according to claim 8, wherein the photoconductive drum further includes an insulating surface layer over the photoconductive layer, and wherein the brush portion of said charging brush contacts the insulating surface layer when the alternating electric field is applied.

10. An image forming apparatus, comprising:

a drum including an electroconductive substrate and an insulating surface layer over the electroconductive substrate, the electroconductive substrate of said drum being grounded;

a charging brush configured to charge a surface of said drum;

a rotation drive section configured to rotatably drive said charging brush;

an alternating electric field supply section configured to apply an alternating electric field to a brush portion of said charging brush, wherein the brush portion of said charging brush contacts the insulating surface layer of said drum to vibrate the brush portion of said charging brush, while the alternating electric field is applied to the brush portion of said charging brush and while said charging brush and said drum are rotated, thereby removing fouling from the brush portion of said charging brush; and a current control section, provided in said alternating electric field supply section, configured to detect a current applied to the brush portion of said charging brush and preventing a flow of excessive current through the brush portion of said charging brush.

11. An image forming apparatus, comprising:

a drum including an electroconductive substrate and an insulating surface layer over the electroconductive substrate, the electroconductive substrate of said drum being grounded;

a charging brush configured to charge a surface of said drum;

a rotation drive section configured to rotatably drive said charging brush;

an alternating electric field supply section configured to apply an alternating electric field to a brush portion of said charging brush, wherein the brush portion of said charging brush contacts the insulating surface layer of said drum to vibrate the brush portion of said charging brush, while the alternating electric field is applied to the brush portion of said charging brush and while said charging brush and said drum are rotated, thereby removing fouling from the brush portion of said charging brush;

a current control section, provided in said alternating electric field supply section, configured to detect a current applied to the brush portion of said charging brush and preventing a flow of excessive current through the brush portion of said charging brush; and an alarm section configured to indicate an excessive current when a passage of said current equal to or greater than a predetermined value is detected.

12. An image forming process cartridge, comprising:

a photoconductive drum including an electroconductive substrate, an photoconductive layer, and an insulating surface layer over the photoconductive layer, the electroconductive substrate of said photoconductive drum being grounded;

a rotation drive section configured to rotatably drive said photoconductive drum;

a charging brush configured to charge a surface of said photoconductive drum; and an alternating electric supply section configured to apply an alternating electric field not including a DC component to a brush portion of said charging brush, wherein the brush portion of said charging brush contacts the insulating surface of said photoconductive drum to vibrate the brush portion of said charging brush, while the alternating electric field is applied to the brush portion of said charging brush and while said charging brush and said photoconductive drum are rotated, thereby removing fouling from the brush portion of said charging brush.

13. An image forming process cartridge, comprising:

a photoconductive drum including an electroconductive substrate, an photoconductive layer, and an insulating surface layer over the photoconductive layer, the electroconductive substrate of said photoconductive drum being grounded;

a rotation drive section configured to rotatably drive said photoconductive drum;

a charging brush configured to charge a surface of said photoconductive drum;

an alternating electric supply section configured to apply an alternating electric field to a brush portion of said charging brush, wherein the brush portion of said charging brush contacts the insulating surface of said photoconductive drum to vibrate the brush portion of said charging brush, while the alternating electric field is applied to the brush portion of said charging brush and while said charging brush and said photoconductive drum are rotated, thereby removing fouling from the brush portion of said charging brush; and a current control section, provided in said alternating electric field supply section, configured to detect a current applied to the brush portion of said charging brush and to prevent excessive current flow through the brush portion of said charging brush.

14. An image forming process cartridge, comprising:

a photoconductive drum including an electroconductive substrate, an photoconductive layer, and an insulating surface layer over the photoconductive layer, the electroconductive substrate of said photoconductive drum being grounded;

a rotation drive section configured to rotatably drive said photoconductive drum;

a charging brush configured to charge a surface of said photoconductive drum;

an alternating electric supply section configured to apply an alternating electric field to a brush portion of said charging brush, wherein the brush portion of said charging brush contacts the insulating surface of said photoconductive drum to vibrate the brush portion of said charging brush, while the alternating electric field is applied to the brush portion of said charging brush and while said charging brush and said photoconductive drum are rotated, thereby removing fouling from the brush portion of said charging brush;

a current control section, provided in said alternating electric field supply section, configured to detect a current applied to the brush portion of said charging brush and to prevent excessive current flow through the brush portion of said charging brush; and an alarm section configured to indicate an excessive current when a passage of said current equal to or greater than a predetermined value is detected.

15. An image forming apparatus, comprising:

a drum means including an electroconductive substrate and an insulating surface layer over the electroconductive substrate, the electroconductive substrate of said drum being grounded;

a charging brush means for charging a surface of said drum means;

a rotation drive means for rotatably driving said charging brush means; and an alternating electric field supply means for applying an alternating electric field not including a DC component to a brush portion of said charging brush means, wherein the brush portion of said charging brush means contacts the insulating surface layer of said drum means to vibrate the brush portion of said charging brush means, while the alternating electric field is applied to the brush portion of said charging brush means and while said charging brush means and said drum means are rotated, thereby removing fouling from the brush portion of said charging brush means.

16. The image forming apparatus according to claim 15, wherein said drum means is a photoconductive drum means.

17. The image forming apparatus according to claim 16, wherein the photoconductive drum means further includes an insulating surface layer over the photoconductive layer, and wherein the brush portion of said charging brush means contacts the insulating surface layer when the altering electric field is applied.

18. An image forming apparatus, comprising:

a drum means including an electroconductive substrate and an insulating surface layer over the electroconductive substrate, the electroconductive substrate of said drum being grounded;

a charging brush means for charging a surface of said drum means;

a rotation drive means for rotatably driving said charging brush means;

an alternating electric field supply means for applying an alternating electric field to a brush portion of said charging brush means, wherein the brush portion of said charging brush means contacts the insulating surface layer of said drum means to vibrate the brush portion of said charging brush means, while the alternating electric field is applied to the brush portion of said charging brush means and while said charging brush means and said drum means are rotated, thereby removing fouling from the brush portion of said charging brush means; and a current control means, provided in said alternating electric field supply means, for detecting a current applied to the brush portion of said charging brush means and preventing excessive current flow through the brush portion of said charging brush means.

19. An image forming apparatus, comprising:

a drum means including an electroconductive substrate and an insulating surface layer over the electroconductive substrate, the electroconductive substrate of said drum being grounded;

a charging brush means for charging a surface of said drum means;

a rotation drive means for rotatably driving said charging brush means;

an alternating electric field supply means for applying an alternating electric field to a brush portion of said charging brush means, wherein the brush portion of said charging brush means contacts the insulating surface layer of said drum means to vibrate the brush portion of said charging brush means, while the alternating electric field is applied to the brush portion of said charging brush means and while said charging brush means and said drum means are rotated, thereby removing fouling from the brush portion of said charging brush means;

a current control means, provided in said alternating electric field supply means, for detecting a current applied to the brush portion of said charging brush means and preventing excessive current flow through the brush portion of said charging brush means; and an alarm means for indicating an excessive current when a passage of said current equal to or greater than a predetermined value is detected.

20. An image forming process cartridge, comprising:

a photoconductive drum means including an electroconductive substrate, an photoconductive layer, and an insulating surface layer over the photoconductive layer, the electroconductive substrate of said photoconductive drum means being grounded;

a rotation drive means for rotatably driving said photoconductive drum means;

a charging brush means for charging a surface of said photoconductive drum means; and an alternating electric supply means for applying an alternating electric field not including a DC component to a brush portion of said charging brush means, wherein the brush portion of said charging brush means contacts the insulating surface of said photoconductive drum means to: vibrate the brush portion of said charging brush means, while the alternating electric field is applied to the brush portion of said charging brush means and while said charging brush means and said photoconductive drum means are rotated, thereby removing fouling from the brush portion of said charging brush means.

21. An image forming process cartridge, comprising:

a photoconductive drum means including an electroconductive substrate, an photoconductive layer, and an insulating surface layer over the photoconductive layer, the electroconductive substrate of said photoconductive drum means being grounded;

a rotation drive means for rotatably driving said photoconductive drum means;

a charging brush means for charging a surface of said photoconductive drum means;

an alternating electric supply means for applying an alternating electric field to a brush portion of said charging brush means, wherein the brush portion of said charging brush means contacts the insulating surface of said photoconductive drum means to vibrate the brush portion of said charging brush means, while the alternating electric field is applied to the brush portion of said charging brush means and while said charging brush means and said photoconductive drum means are rotated, thereby removing fouling from the brush portion of said charging brush means; and a current control means, provided in said alternating electric field supply means for detecting a current applied to the brush portion of said charging brush means so as to prevent excessive current flow through the brush portion of said charging brush means.

22. An image forming process cartridge, comprising:

a photoconductive drum means including an electroconductive substrate, an photoconductive layer, and an insulating surface layer over the photoconductive layer, the electroconductive substrate of said photoconductive drum means being grounded;

a rotation drive means for rotatably driving said photoconductive drum means;

a charging brush means for charging a surface of said photoconductive drum means; and an alternating electric supply means for applying an alternating electric field to a brush portion of said charging brush means, wherein the brush portion of said charging brush means contacts the insulating surface of said photoconductive drum means to vibrate the brush portion of said charging brush means, while the alternating electric field is applied to the brush portion of said charging brush means and while said charging brush means and said photoconductive drum means are rotated, thereby removing fouling from the brush portion of said charging brush means;

a current control means, provided in said alternating electric field supply means for detecting a current applied to the brush portion of said charging brush means so as to prevent excessive current flow through the brush portion of said charging brush means; and an alarm means for indicating an excessive current when a passage of said current equal to or greater than a predetermined value is detected.

23. A method of removing fouling from a brush that has electrically conductive threads of bristles for applying a charge to a photoconductive (PC) member, said threads or bristles being subject to fouling by materials such as toner, comprising:

causing relative rotation between the brush and the PC member; and creating an alternating current (AC) electric field not including a DC component acting on the threads or bristles to cause vibration thereof during said relative rotation and thereby shed fouling therefrom.

24. A method as in claim 23 in which said PC member has an electrically conductive backing and said creating an AC field comprises applying an AC voltage between the conductive backing and the threads or bristles.

25. A method as in claim 23 in which said AC field has a frequency of the order of 2,000 Hz.

* * * * *